US006259030B1

(12) United States Patent
Tanigawa et al.

(10) Patent No.: US 6,259,030 B1
(45) **Date of Patent: *Jul. 10, 2001**

(54) ELECTRICAL CABLES ADAPTED FOR HIGH VOLTAGE APPLICATIONS

(75) Inventors: Hidemi Tanigawa; Yoshinao Kobayashi; Masanobu Okazaki, all of Yokkaichi (JP)

(73) Assignee: Sumitomo Wiring Systems, Ltd., Yokkaichi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,897

(22) Filed: Mar. 11, 1999

(30) Foreign Application Priority Data

Mar. 12, 1998 (JP) ..... 10-060925

(51) Int. Cl.[7] ..... H01B 7/18
(52) U.S. Cl. ..... 174/108; 338/214
(58) Field of Search ..... 174/102 SC, 108, 174/110 PM, 120 SC, 36; 338/66, 214

(56) References Cited

U.S. PATENT DOCUMENTS 3,191,132 6/1965 Mayer ..... 333/79
4,301,428 * 11/1981 Mayer ..... 174/36 X
4,506,235 * 3/1985 Mayer ..... 174/36 X
4,970,488 * 11/1990 Horiike et al. ..... 338/214
5,046,240 * 9/1991 Fujimoto ..... 338/214 X
5,057,812 * 10/1991 Yakawa et al. ..... 338/66
5,576,514 * 11/1996 Fujimoto et al. ..... 174/120 SC X

* cited by examiner

*Primary Examiner*—Dean A. Reichard
*Assistant Examiner*—Chau N. Nguyen
(74) *Attorney, Agent, or Firm*—Greenblum, Bernstein, P.L.C.

(57) ABSTRACT

An electrical cable for high-voltage circuits is used in fixed type apparatuses such as office or home appliances. The electrical cable includes a tubular core portion formed of fluorine rubber and a magnetic material mixed therewith. The tubular core portion is wound with a conductive wire. The diameter of the conductive wire is set to be about 40 $\mu$m at the most, so that number of spirals can be more than about 10,000 spirals/m. Under these conditions, even when the electrical cable is flexed, spirals of the conductive wire are prevented from being superposed or stacked. The electrical cable can thus be provided with a high impedance and prevented from noise penetration.

6 Claims, 2 Drawing Sheets

ELECTRICAL CABLES ADAPTED FOR HIGH VOLTAGE APPLICATIONS

BACKGROUND OF THE INVENTION

1. Field of the Invention

The invention relates to a cable adapted for high voltages applications. The cable can be used with fixed apparatus which are either permanently installed or temporarily installed at a given location, such as office equipment, machinery, home appliances, etc. Such apparatuses may use or produce high voltages, in which case some parts of the apparatuses can generate high-voltage noise. The present invention more particularly concerns electrical cables for the high-voltage circuits used in the those parts susceptible to generation of high-voltage noise.

2. Description of Background Information

Known electrical cables for high-voltage circuits may be classified into two categories. The first category includes a cable system in which copper-conductor cables are used in a general manner, but in which downstream portions employ cables which contain a ferrite core portion in order to suppress noise (hereinafter designated "prior art I"). The second category includes a cable system which uses reinforced cables made of aramid fiber, glass fiber, etc., the surface of which is covered with conductive carbon to make the cable conducting. With this type of cable, noise is suppressed by increasing the impedance of the carbon portion of the conductive cables (hereinafter designated "prior art II").

It is also known that improved high-voltage breakdown resistance can be achieved by twisting together a plurality of conductive wires 1 to form a cable suitable for high-voltage circuits (FIG. 1). With this cable, the surface of the twisted conductive wires 1 is made uniformly smooth, so that the electrical voltage is prevented from concentrating on particular points. To this end, the twisted conductive wires 1 are coated with an electrically conductive resin 2 through an extrusion process, and are then provided with an insulating coating 3 (hereinafter designated "prior art III").

With this "prior art III", a material having a good high voltage breakdown resistance and a good extrudability, such as low-density polyethylene (LDPE) or crosslinked LDPE, may be used as the insulating coating 3. Currently, it is required that office or home appliances must be non-flammable. As pure polyethylene resins are flammable, flame retarders are usually added to these resins to meet the requirement for non-flammability.

With a cable for high-voltage circuits which includes a ferrite core portion ("prior art I"), it is difficult to suppress noise over a broad frequency spectrum. Therefore, additional means have to be adopted for effective noise suppression. However, these additional means involve extra costs, due to the supplementary manufacturing steps they require.

When a conductive cable is prepared by coating carbon around a reinforcing thread through a baking process ("prior art II"), the impedance may be set to a high level in order to remove high-voltage noise. However, the resulting conductive cable has a structure which does not form inductance elements, and therefore noise cannot be suppressed efficiently.

With "prior art III", the electrically conductive resin 2 will become thermally deteriorated after a long-term use, and form fine cracks on its surface. High-voltage fields will then tend to concentrate at these cracks. When a high voltage is charged in this state, dielectric breakdowns may occur, and the conductive wire 1 can then no longer serve as a high-voltage cable.

In addition, the end portions of the electrical cable must be prepared for high-voltage circuits by connecting metal terminals thereto. In the case of "prior art III", the connections established during this preparation process can sometimes be made through the electrically conductive resin 2, which causes impedance fluctuations. The impedance may also vary after prolonged use, owing to the deterioration of electrically conductive resin 2. Moreover, the grip for holding the terminals may be weakened, with the high-voltage resistance subsequently being deteriorated.

Moreover, when a low-density polyethylene is used, as in the case with "prior art III", the resulting electrical cable deforms at high temperatures. This may lead to some cable characteristics, such as behavior during the so-called "high-voltage cutting-through test", which deviates from the standards adopted by Underwriters' Laboratories Inc. (UL Standards) in active use in the United States. In such a case, a flame retarder can be added to make the cable more fireproof. However, such an additive lowers the cable's voltage breakdown resistance. A solution would be to maintain the breakdown resistance by making the insulating coating thicker. However, such a measure would be at the expense of the cable's plasticity, the resulting electrical cable for high-voltage circuits then becomes less flexible.

SUMMARY OF THE INVENTION

An object of the present invention is therefore to provide an electrical cable for high-voltage circuits, which can be used in fixed type machinery and tools. The cable according to the present invention generates less noise, has a high electrical breakdown resistance, is non-flammable and easy to handle.

To this end, there is provided an electrical cable for high-voltage circuits, used in fixed type apparatuses such as office or home appliances.

The electrical cable according to the present invention includes a core portion for winding a wire therearound, the core portion being formed of fluorine rubber and a magnetic material mixed therewith, an electrically conductive wire around the core portion, so as to form a given number of spirals therearound, and an insulating layer coating the electrically conductive wire and the core portion.

Preferably, the electrically conductive wire has a diameter of about 40 $\mu$m at the most and the number of spirals is at least about 10,000 spirals/m.

The insulating layer may include a soft insulating resin having a melting point of at least about 120° C. and containing no flame retarders.

More preferably, the electrical cable has an impedance of about 30 to 35 kΩ.

Further, the electrically conductive wire may be wound around the core portion, while penetrating partially into the core portion.

BRIEF DESCRIPTION OF THE DRAWINGS

The above and other objects, features and advantages of the present invention will be made apparent from the following description of the preferred embodiments, given as non-limiting examples, with reference to the accompanying drawings, in which.

1: common cable subjected to no noise-suppression treatments;

2: cable according to "prior art I";

3: cable according to "prior art II";

4: cable according to the present invention.

DETAILED DESCRIPTION OF THE PREFERRED EMBODIMENTS

Figure 1:
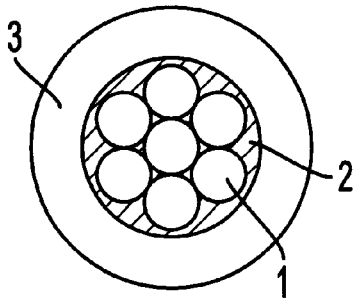
FIG. 1 (PRIOR ART)
FIG. 1 shows a portion of electrical cable for high-voltage circuits according to "prior art III"
Figure 2:
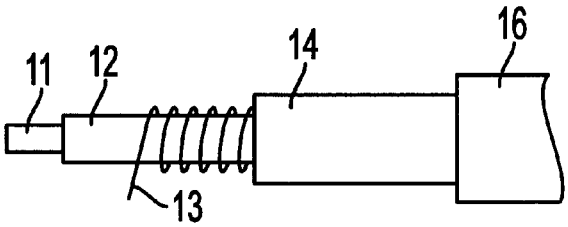
FIG. 2 is a side view of a portion of electrical cable for high-voltage circuits according to an embodiment of the present invention.

FIG. 2 shows an electrical cable for high-voltage circuits according to a first embodiment of the present invention. The cable is manufactured by preparing a reinforcing fibrous thread 11, extruding fluorine rubber mixed with ferrite powder (magnetic material) around that thread, thereby obtaining a tubular core portion 12, and winding a conductive wire 13 around that core portion. An insulating layer 14 is then formed by extrusion around the core portion 12 and is covered with a sheath 16.

The reinforcing thread 11 may be formed of any suitable reinforcing fiber, such as an aramid fiber or a glass fiber which has a diameter of about 0.6 mm.

As mentioned above, the tubular core portion 12 contains a fluorine rubber and ferrite powder. The fluorine rubber is mixed with a reinforcing polymer, compatible with the fluorine rubber, which is blended with copolymer of ethylene and vinyl acetate (EVA). These two copolymer-components can be vulcanized simultaneously. Copolymer EVA is added in proportion of about 5 to 25 parts by weight, relative to about 100 parts by weight of fluorine rubber. The tubular core portion 12 is prepared so as to have a diameter of about 1.3 mm. The ferrite powder contained in the tubular core portion 12 includes, for example, a Mn-Zn type ferrite, such as manganese-zinc-Iron oxides (Mn-Zn-FE oxides). The ferrite powder is mixed is an amount to make up 40–90% by weight of core portion 12.

Figure 3:
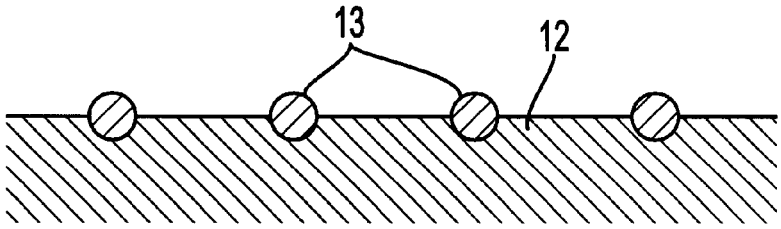
FIG. 3 is a cross-sectional view of part of the electrical cable of FIG. 2, in which the conductive wire is thrust onto the tubular core portion.

The conductive wire 13 may be a resistance wire made of a nickel-chromium alloy or stainless steel, and has a diameter of not more that about 40 $\mu$m. The conductive wire 13 is wound around the tubular core portion 12, prior to vulcanization, at a pitch of at least about 10,000 spirals/m. The fluorine rubber in the tubular core portion 12 has a hardness, prior to vulcanization, adapted so that the conductive wire 13 penetrates into the tubular core portion 12 by an extent corresponding to at least about 5% of the diametrical height of conductive wire 13, measured on the plane perpendicular to the surface of tubular core portion 12. Preferably, the conductive wire 13 penetrated into the core portion 12 by an amount corresponding to about 50% of the diametrical height of conductive wire 13, as shown in FIG. 3. This partially embedded state is maintained during subsequent vulcanization treatments, which are carried out at about 160° C. for about 30 minutes.

The insulating layer 14 is made of a flexible crosslinked polyethylene material having a melting point of at least about 120° C. This polyethylene material does not contain additives such as a flame retarder, in order not to lower the electrical breakdown resistance.

For the preparation of the insulating layer 14, a polyethylene material, such as a high-density polyethylene (HDPE) or a linear low-density polyethylene (LLDPE), is first extruded to form a layer. The layer is then subjected to crosslinking by electron beams or to a silane crosslinking process. Further, an economical, formable and highly non-flammable material, such as poly (vinyl chloride), is extruded over the above-mentioned layer 14 in order to make it non-flammable. Therefore, the insulating layer 14 formed in this way has a two-layer structure. Moreover, insulating layer 14 is prepared so as to have a thickness of about 0.3 to 0.7 mm, for example about 0.65 mm, and an outer diameter of about 2.6 mm.

The sheath 16 is made of an insulating resin such as poly (vinyl chloride). The thickness of the sheath is set to be about the same as, or slightly more than, that of insulating layer 14, e.g. about 0.75 mm. while its outer diameter is about 4.1 mm. By contrast with high-voltage cables used in the automobile industry, the electrical cable in the field of the present invention is not required to have high temperature resistance, such as in a temperature range of 180 to 200° C. Therefore, sheath 16 need only be heat-resistant to about 105° C. at the most. The material for sheath 16 can thus be chosen from a wider range of products. It is often selected from among flexible products.

The electrical cable for high-voltage circuits has a similar structure to that of high-voltage cables for automobiles. However, in high-voltage cables for automobiles, the diameter of a conductive wire that is wound around a tubular core portion is about 50 to 60 $\mu$m and its winding density is about 1,000 to 5000 spirals/m. By comparison, the corresponding figures are about 40 $\mu$m and above 10,000 spirals/m, respectively, with electrical cables for high-voltage circuits used in fixed apparatuses.

The reason for using a thicker conductive wire (about 50 to 60 $\mu$m) in automobiles is firstly that the wire has to resist vibrations due to automotive movements and secondly that it has to carry longer wiring paths, so as to secure reliability in the wiring system. Accordingly, spiral pitches for the conductive wire are set rather large in automobiles, so as to prevent the spirals from being stacked or superposed when the high-voltage cable is flexed. On the other hand, the electrical cable for high-voltage circuits according to the present invention is used in fixed type apparatuses, such as office machinery and tools, or home appliances, which are installed in a fixed or immobile state. Accordingly, the conductive wire 13 can be made thinner without taking vibration problems into account. This is a marked difference with respect to high-voltage cables used in automobiles. Consequently, spiral pitches can be set denser, without risks of stacking, even if the conductive wire is flexed.

Further, in high-voltage cables for common automobiles, the mixing proportion of ferrite powder in the tubular core portion ranges from about 300 to 500 parts by weight, relative to about 100 parts by weight for the rest (75 to 83% by weight of the total). On the other hand, in the electrical cables for high-voltage circuits according to the present invention, in an amount to make up 40–90% by weight of core portion 12.

Usually, the impedance (resistance) tends to increase proportionally with the square of the number of spirals. Accordingly, the impedance is usually set to be between 16 and 19 kΩ/m in the case of high-voltage cables for automobiles. By contrast, the impedance is set higher, i.e. in the range of about 30 to 35 kΩ/m, in the electrical cable for high-voltage circuits according to the present invention.

Tests for high-voltage noise are carried out for several types of cables in a frequency range of 30 to 1,000 MHZ.

Figure 4:
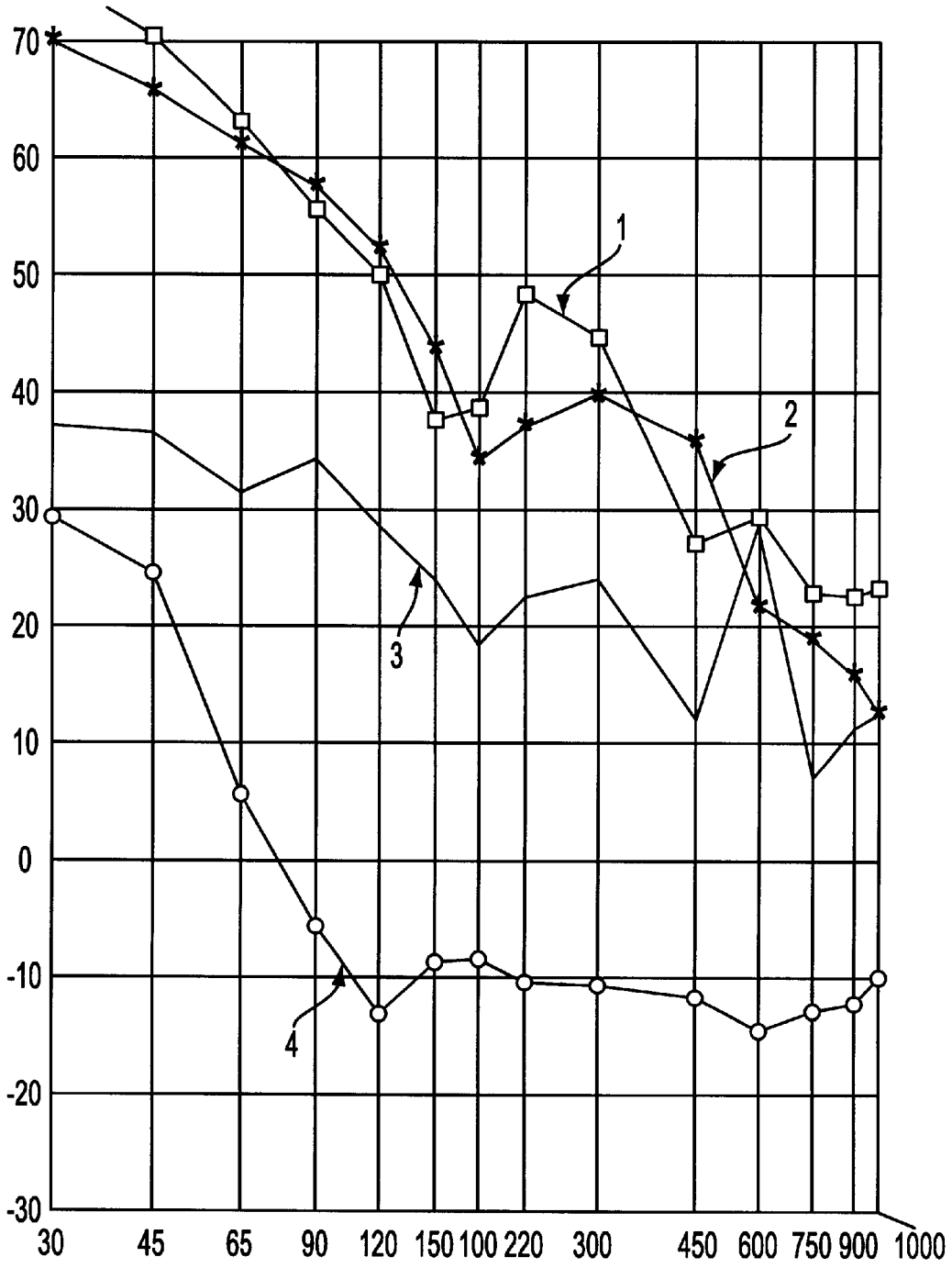
FIG. 4 shows the wavelength-dependent distribution-curves of high-voltage noise (abscissa: frequency zone in MHZ; ordinate: noise penetration level in dB$\mu$A), measured for each of the following cables.

The results of the tests are shown in FIG. 4, in which the abscissa represents frequencies (MHZ) and the ordinate represents noise penetration levels (dB$\mu$A). Numerals 1, 2, 3 and 4 in this figure respectively refer to:

a common electrical cable for which no noise-prevention treatments are applied (common cable), a cable according to "prior art I" (common cable provided with a ferrite core), a cable according to "prior art II" (cable having an impedance of 10 k.), and an electrical cable for high-voltage circuits according to the present invention. As can be seen in FIG. 4, the cable according to the present invention has the lowest noise levels among the above-mentioned cables, indicating that the greatest noise-reduction effect is obtained with the cable according to the present invention.

In order to be used for wiring inside office appliances, the wire must satisfy a number of requirements. The electrical cable according to the present invention gives satisfactory results in tests for high-voltage breakdown resistance, for non-flammability, and in the so-called cutting-through test under high-voltage, which are defined by UL Standards.

Furthermore, it will be recalled that conductive wire 13 is wound around tubular core portion 12 while penetrating partially into the latter. By virtue of this configuration, the wound conductive wire 13 is prevented from shifting. Further, when winding the conductive wire 13 around tubular core portion 12, or connecting an end portion of the electric wire for high-voltage circuits to a metal terminal, the electrical cable is subjected to peeling or folding stresses. The inventive conductive wire 13 in no longer susceptible to loosening by these types of stresses. Shifting of the spiral pitches or breakage of the conductive wire can also be avoided.

In the above embodiment of the present invention, polyethylene is used as the material for the insulating layer 14. Alternatively, a soft insulating resin such as silicone may also be used.

Further, in the above embodiment, the wound conductive wire 13 is coated with insulating layer 14 and further covered with a sheath 16. In this structure, the sheath 16 may be formed of an insulating material. Furthermore, a high resistivity semiconductor containing conductive particles may be interposed between the conductive wire 13 and the insulating layer 14.

The electrical cable for high-voltage circuits of the invention is used in office or home appliances that are installed in an immobile or fixed state. In such an electrical cable, a conductive wire is wound around a tubular core portion. As the diameter of the conductive wire is set to be not greater than about 40 $\mu$m, the number of spirals of the conductive wire can be about 10,000 spirals/m or more. With such a number of spirals, the spirals of the wound conductive wire can be prevented from being superposed, even when folding the electric wire. Also, this structure provides a high impedance to the electrical cable, so that high-voltage noise is greatly reduced compared with common cables and the cables according to "prior art I" and "prior art II".

Further, the insulating layer may include a soft insulating resin having a melting point of at least about 120° C. and containing no flame retarder. Such characteristics are eminently suited for fixed type apparatuses and create economical advantages.

Furthermore, the conductive wire is wound around the tubular core portion, with the wire penetrating partially into the core portion. This structure avoids biasing the wound conductive wire. Usually, when winding the conductive wire around the tubular core portion, or when connecting an end portion of the electrical cable to a metal terminal, the conductive wire may become loose by peeling or folding stresses. In the electrical cable according to the present invention, a destructuring of the conductive wire can be avoided. Displacement of the spiral pitches of the wound conductive wire or its breakage can thus be prevented.

Although the invention has been described with reference to particular means, materials, and embodiments, it is to be understood that the invention is not limited to the particulars disclosed and extends to all equivalents within the scope of the claims.

The present disclosure relates to subject-matter contained in the priority Japanese Application No. HEI-100-60925, filed on Mar. 12, 1998, which is herein expressly incorporated by reference in its entirety.

What is claimed:

1. An electrical cable for high-voltage circuits, said electrical cable adapted for use in fixed type apparatuses, said electrical cable comprising:

a reinforcing fibrous thread;

a tubular core portion having a diameter of about 1.3 mm for winding a wire therearound, said core portion comprising fluorine rubber and a ferrite powder mixed therewith, said ferrite powder comprising at least about 40% and less than about 85% by weight of said core portion;

wherein the fluorine rubber is mixed with a reinforcing polymer compatible with the fluorine rubber, which is blended with a copolymer of ethylene and vinyl acetate;

an electrically conductive wire, wound around said core portion so as to form a predetermined number of spirals therearound;

wherein said electrically conductive wire has a diameter of not more than about 40 micrometers and said number of spirals being at least about 10,000 spirals/m; and wherein said electrically conductive wire is wound around said core portion while penetrating partially into said core;

an insulating layer covering said conductive wire and said core portion, comprising two sublayers, the two sublayers comprising;

an inner layer of a flexible crosslinked polyethylene coating having a melting point of at least 120 degrees C. and containing no flame retarders;

an outer layer of a non-flammable material extruded over said crosslinked polyethylene;

a polyvinyl chloride (PVC) sheath around said insulating layer; and wherein said electrical cable has an impedance of about 30 to 35 kohms.

2. The electrical cable according to claim 1, wherein said reinforcing fibrous thread has a diameter of about 0.6 mm.

3. The electrical cable according to claim 1, wherein said copolymer of ethylene and vinyl acetate is vulcanized simultaneously and then added in proportion of about 5 to 25 parts by weight relative to about 100 parts by weight of fluorine rubber.

4. The electrical cable according to claim 1, wherein said electrically conductive wire penetrates partially into said core by an extent corresponding to at least about 5% of the diametrical height of said conductive wire measured in a plane perpendicular to the surface of the tubular core portion.

5. The electrical cable according to claim 1, wherein said insulating layer has a thickness of about 0.3 to 0.7 mm.

6. The electrical cable according to claim 1, said sheath having a thickness of about 0.75 mm, an outer diameter of about 4.1 mm, and being heat resistant to about 105 degrees C.

* * * * *

UNITED STATES PATENT AND TRADEMARK OFFICE

CERTIFICATE OF CORRECTION

PATENT NO. : 6,259,030 B1
DATED : July 10, 2001
INVENTOR(S) : H. Tanigawa et al.

It is certified that error appears in the above-identified patent and that said Letters Patent is hereby corrected as shown below:

Title page,
Item [56], References Cited, the following FOREIGN PATENT DOCUMENTS were omitted and should be included:

| | | |
|---|---|---|
| -- 0766268 | 4/1997 | EPO |
| 0690459 | 1/1996 | EPO -- |

Signed and Sealed this

Twenty-fifth Day of December, 2001

*Attest:*

*Attesting Officer*

JAMES E. ROGAN
*Director of the United States Patent and Trademark Office*